US010206257B2

(12) United States Patent
Luo

(10) Patent No.: US 10,206,257 B2
(45) Date of Patent: Feb. 12, 2019

(54) STEPLESS DIMMING CONTROL METHOD OF LIGHTING SYSTEM

(71) Applicant: Wuning Luo, Nanning (CN)

(72) Inventor: Wuning Luo, Nanning (CN)

( * ) Notice: Subject to any disclaimer, the term of this patent is extended or adjusted under 35 U.S.C. 154(b) by 0 days.

(21) Appl. No.: 15/534,482

(22) PCT Filed: Dec. 9, 2015

(86) PCT No.: PCT/CN2015/096806

§ 371 (c)(1),
(2) Date: Jun. 8, 2017

(87) PCT Pub. No.: WO2016/091170

PCT Pub. Date: Jun. 16, 2016

(65) Prior Publication Data

US 2017/0354006 A1 Dec. 7, 2017

(30) Foreign Application Priority Data

Dec. 12, 2014 (CN) ..... 2014 1 0761684

(51) Int. Cl.
*H05B 33/08* (2006.01)
*H05B 37/02* (2006.01)
(Continued)

(52) U.S. Cl.
CPC ..... *H05B 33/0845* (2013.01); *H05B 33/089* (2013.01); *H05B 37/02* (2013.01);
(Continued)

(58) Field of Classification Search
CPC ..... H05B 33/0806; H05B 33/0833; H05B 33/0845; H05B 33/0848
(Continued)

(56) References Cited

U.S. PATENT DOCUMENTS 9,155,138 B2 * 10/2015 Snelten ..... H05B 33/0815
9,247,608 B2 * 1/2016 Chitta ..... H02M 1/08
(Continued)

*Primary Examiner* — Thuy Vinh Tran
(74) *Attorney, Agent, or Firm* — Raymond Y. Chan; David and Raymond Patent Firm

(57) ABSTRACT

A stepless dimming control method of a lighting system is applicable to the situations where a light source for a lighting terminal is a fluorescent lamp and/or an LED lamp. A pulsating voltage regulating device is connected in series with a main power supply circuit of a terminal light source. A dimming control unit is configured for a fluorescent lamp electronic ballast/LED driving unit. The specific method includes: at first, fluctuating a supply voltage value at an input end of the electronic ballast/LED driving unit for a short time by the pulsating voltage regulating device, and then regulating, by the dimming control unit, an output frequency of the electronic ballast and an output current of the LED driving unit according to fluctuation parameters and also in combination with preset system settings, so as to realize dimming. The method can realize remote and stepless dimming, is applicable to the terminal light sources of both fluorescent lamps and LED lamps, has good interference resistance and relatively low system construction/improvement costs, and is extremely suitable for newly-built lighting systems and for use in upgrading existing lighting systems.

20 Claims, 5 Drawing Sheets

(51) Int. Cl.
*H05B 41/39* (2006.01)
*H05B 41/36* (2006.01)

(52) U.S. Cl.
CPC ..... *H05B 37/0263* (2013.01); *H05B 41/39* (2013.01); *H05B 33/0848* (2013.01); *H05B 41/36* (2013.01)

(58) Field of Classification Search
USPC ..... 315/185 R, 291, 307, 308, 360
See application file for complete search history.

(56) References Cited

U.S. PATENT DOCUMENTS

2017/0071039 A1* 3/2017 Chitta ..... H02M 1/08
2017/0265260 A1* 9/2017 Briggs ..... H05B 33/0815

* cited by examiner

STEPLESS DIMMING CONTROL METHOD OF LIGHTING SYSTEM

CROSS REFERENCE OF RELATED APPLICATION

This application is a non-provisional application that claims the benefit of priority under 35 U.S.C. § 371 to international PCT application, application number PCT/CN2015/096806, filed Dec. 9, 2015, which is incorporated herewith by reference in its entity.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to the field of lighting control, and more particularly to a stepless dimming control method of lighting system.

Description of Related Art

Fluorescent lamp and LED light are very common terminal light source in the market of illumination. In order to function, fluorescent lamp is required to have an electronic ballast arranged thereon for rectifying and inverting the line frequency alternating current supply provided by the power system into high frequency alternating current supply according to the need of the luminescence of the fluorescent lamp. Also, LED light is required to have a LED driving unit for converting the alternating current supply provided by the power system into direct-current power supply according to the need of the luminescence of the LED light. Common LED driving unit comprises a LED inverter power supply, a LED high voltage drive unit (such as ACHV drive IC and its peripheral circuit), and etc.

The function of fluorescent lamps and LED lights currently in the market is relatively simple, which usually does not include dimming function, especially remote dimming function. Occasionally, there are few technical solutions of dimming fluorescent lamp being disclosed. For example, China Patent No. CN101646296A discloses a solution that conduct communication control via power line communication, which drawbacks include relatively complex equipment and uncertain control signal quality that misoperation can occur due to interference. Besides, it requires the electronic ballast and fluorescent lamp to work at full capacity for long that lives of the electronic ballast and lamps can be affected. In addition, because LED requires constant current supply or can be aged and damaged easily, it cannot apply the standard and direct way that adjust the voltage of the two ends of the lamp to conduct its dimming. It was discovered through market survey that conventional LEDs usually work in a constant luminance manner, which apply constant power output.

SUMMARY OF THE PRESENT INVENTION

An object of the present invention is to provide a stepless dimming control method of lighting system that is adapted for terminal light sources of both fluorescent lamp and LED light and easy to be converted from a conventional lighting system to provide remote dimming function.

The following technical solutions provide stepless dimming control methods of lighting system according to the present invention.

I. First Solution

First, the lighting system that employs the present invention can be applied to fluorescent lamp, LED light, a hybrid system of the two, and etc. In a preferred embodiment, a fluorescent lamp also needs an electronic ballast arranged thereon and a LED light also needs a LED driving unit arranged thereon. The special features include that a smart pulse voltage adjustment device is connected on the power supply circuit of the terminal light source (electronic ballast, LED light, etc.) in series and a dimming control unit comprises a voltage sensing circuit and a single chip microcomputer arranged on the electronic ballast/LED driving unit for monitoring the power supply voltage of the input terminal of the electronic ballast/LED driving unit and adjusting the output frequency of the electronic ballast and the output current of the LED driving unit according to the change of the power supply voltage and based on the predetermined rules of the system, so as to implement dimming of the fluorescent lamp/LED light.

When dimming is required, it comprises the following method and procedures:

(i) firstly, causing the value of the power supply voltage of the input terminal of the electronic ballast/LED driving unit to generate a short-time fluctuation by slightly adjusting the output voltage of the smart pulse voltage adjustment device, wherein the short-time fluctuation is defined as first signaling, wherein the fluctuation duration of the first signaling is T1;

(ii) causing the value of the power supply voltage of the input terminal of the electronic ballast/LED driving unit to generate a short-time fluctuation by slightly adjusting the output voltage of the smart pulse voltage adjustment device again after a time interval of T2, wherein this short-time fluctuation is defined as second signaling, wherein the fluctuation duration of the second signaling is T3, wherein the fluctuation duration T3 has predetermined corresponding relation with the target dimming extent; and (iii) comparing the durations of T1, T2, and T3 with the predetermined value of the system after the dimming control unit detected the above fluctuations of the value of the power supply voltage of the input terminal of the electronic ballast/LED driving unit, wherein if the values are equal, this dimming procedure will really be launched that the output frequency of the electronic ballast and the output current of the LED driving unit will be adjusted to corresponding values according to the target dimming extent obtained by configuring the dimming control unit to check the predetermined value of the system according to the fluctuation duration of T3, wherein if the values are not equal, this dimming procedure will be terminated.

According to the general knowledge of those skilled in the art, the LED driving unit of the above solution (I) may also be adapted for either situation of the LED inverter power supply or the LED high voltage drive unit being employed.

In addition, the function of the smart pulse voltage adjustment device of the above solution (I) comprises generating minor and short-time fluctuations on the voltage value of the power supply of the input terminal of the electronic ballast/LED driving unit. The frequency converter also has the function of adjusting output voltage. Hence, the smart pulse voltage adjustment device of the above solution (I) can also be replaced with a frequency converter, while it can still apply the dimming method and procedures after the replacement.

By utilizing the above method, it can conduct dimming for lighting system just by adjusting the power supply voltage, such that remote dimming becomes easy to achieve. When dimming, the extremely low frequency first signaling and second signaling are adjusted via the pulse voltage adjustment device or frequency converter and the commands are confirmed. Then, it really launches dimming. This implementation not only achieves convenient and highly effective stepless dimming, but also effectively avoids the interference brought by voltage fluctuation of the power system.

Alternatively, it can also employ another similar implementation to conduct dimming. This preferred embodiment introduced below is different from the previous preferred embodiment as follows. The interval time, T2, between the first signaling and the second signaling is predetermined to have predetermined corresponding relation to the target dimming extent. Then, the information comprising the wave pattern of the second signaling and/or the fluctuation duration T3 and the wave patterns of the first signaling will be regarded as the basis of determination for really launching this dimming procedure.

The durations of T1, T2, and T3 are compared with the predetermined value of the system after the dimming control unit detected the above fluctuations of the value of the power supply voltage of the input terminal of the electronic ballast/LED driving unit, wherein if the values are equal, the dimming procedure of this time will really be launched that the output frequency of the electronic ballast and the output current of the LED driving unit will be adjusted to corresponding values according to the target dimming extent obtained by configuring the dimming control unit to check the predetermined value of the system according to the interval time of T2, wherein if the values are not equal, the dimming procedure of this time will be terminated.

In order to enhance the interference resistance of the system, so as to be adapted to the special requirements of high demand contexts or some complex operating environments, it can further comprise the following improvement on the basis of the above two embodiments. First, the first signaling and/or the second signaling have one or more times of minor fluctuation on voltage value, wherein after the dimming control unit detected the fluctuation of the voltage value of the power supply of the input terminal of the electronic ballast/LED driving unit, the parameter of the specific wave pattern of the first signaling and/or the second signaling will also be compared with the predetermined value of the system to provide basis of determination for really launching this dimming procedure, wherein the compared parameters of wave pattern comprise the amplitude value of every voltage fluctuation, and/or the duration of every voltage fluctuation, and/or every interval time between the voltage fluctuations.

The adjustment extent mentioned in the "slightly adjusting the output voltage of the smart pulse voltage adjustment device" according to the above program can be determined by person skilled in the art based on the real context. Usually it should facilitate the monitoring of the voltage sensing circuit without rendering obvious fluctuation to the voltage of the power system or bringing adverse effect to the power system. Normally, the adjustment extent should be configured to be within ±50V of the rated voltage, which means that the fluctuation extend is within the range of ±50V.

Similarly, the durations T1, T2, and T3 can respectively be determined by person skilled in the art based on the real context, wherein they can usually be configured to be between 0.2 to 300 seconds.

The following provides a specific embodiment for the dimming control unit, wherein it comprises a single chip microcomputer, PWM signal driving circuit, and a voltage sensing circuit to monitor the power supply voltage of the input terminal of the electronic ballast/LED driving unit. One of the I/O ports or A/D signal receiving ports of the single chip microcomputer is connected with the signal output terminal of the voltage sensing circuit. The single chip microcomputer also comprises a PWM signal output terminal arranged thereon. The PWM signal output terminal is connected with the dimming console of the electronic ballast/LED driving unit via the PWM signal driving circuit. Certainly, if the PWM signal output terminal of a single chip microcomputer is enough to drive the dimming console of the electronic ballast/LED driving unit, the PWM signal driving circuit can also be omitted. Besides, according to the general knowledge of person skilled in the art, the dimming control unit may also leave the mode that utilizes PWM signal control, but implement dimming of fluorescent lamp and LED light through adjusting the output frequency of the electronic ballast and the output current of the LED driving unit via utilizing single chip microcomputer to transmit 0-10 VDC signal to the dimming console of the electronic ballast/LED driving unit.

In the preferred embodiments of the above stepless dimming control methods, because the cost of the dimming control unit is low, when there are multiple fluorescent lamps and/or LED lights, for the sake of the conveniences of establishing and controlling, it's better to arrange one dimming control unit for each electronic ballast/LED driving unit. Nearby terminal light sources in the system with identical dimming tactic may share one pulse voltage adjustment device.

In order to further optimize the above stepless dimming control method of lighting system and to enhance the interference resistance of the system, it can further comprise a step of confirming the received voltage fluctuation before the dimming control unit really launches the dimming procedure to the electronic ballast and the LED driving unit, wherein the dimming procedure will really be launched only if the first signaling is received again or a specific voltage fluctuation is received the designated duration of T4.

Similarly, after the dimming procedure is really launched, it can also additionally comprise a step of detecting if the electric current of the lighting circuit change correspondingly. If the current is not changed correspondingly, this dimming will be considered failed and the dimming procedure will be launched again.

In view of above, the stepless dimming control method of lighting system of the present invention can indeed achieve stepless dimming for fluorescent lamps and LED lights with easy and reliable control methods and great interference resistance. Besides, because the dimming control can be conducted through only adjusting the power supply voltage, it greatly facilitates the conducting of remote dimming. In addition, it can provide dimming input control signal on the spot without requiring adding extra control signal cable, such that it is able to not only significantly save or even completely avoid the construction cost of rearranging/embedding the cables, but also stay away from the risk of signal interferences rendered by long distance wiring. Therefore, the stepless dimming control method of lighting system of the present invention is suitable not only for building new lighting systems, but also for upgrading and transforming existing lighting systems, and especially lighting systems of the road and public area.

II. Second Solution

The following introduce the stepless dimming control method of lighting system according to this second solution by two approaches, the hardware composition and the specific dimming method.

1. Hardware Combination:

The hardware combination of this second solution is mostly the same with it of the above first solution, wherein the differences include the following. First, this second solution only comprises the situation of utilizing frequency converter, but the situation of utilizing pulse voltage adjustment device in the above first solution. Besides, the voltage sensing circuit of the dimming control unit is replaced with a frequency sensing circuit. The functions of the dimming control unit are somewhat different in the present embodiment that it is altered for monitoring the frequency variation of the power supply voltage of the input terminal of the electronic ballast/LED driving unit, and then adjusting the output frequency of the electronic ballast and the output current of the LED driving unit according to the predetermined rules of the system, so as to implement dimming of the fluorescent lamp/LED light.

2. Specific Dimming Method Comprising Utilizing the Following Contents and Rules:

(1) creating corresponding relations between the frequency of the output voltage of the frequency converter and the output frequency of the electronic ballast and the output current of the LED driving unit, which, according to the general knowledge of person skilled in the art, means that it creates corresponding relation to the target dimming extent, or creating corresponding relation between the difference between the frequency of the output voltage of the frequency converter and the rated operating frequency and the target dimming extent; and (2) when dimming is required, adjusting the frequency of the output voltage of the frequency converter to the corresponding value according to the predetermined corresponding relation of the step (1) and the target dimming extent; and configuring the dimming control unit to detect the frequency variation of the power supply voltage of the input terminal of the electronic ballast/LED driving unit, to obtain the target dimming extent by checking with the predetermined corresponding relation, and to adjust the output frequency of the electronic ballast and the output current of the LED driving unit to the corresponding values, so as to implement dimming of the fluorescent lamp/LED light.

In order to avoid disadvantages on the life and operation of the electrical equipment due to the adjustment of the power supply frequency of the power supply, the adjustment on the frequency of the output voltage of the frequency converter, based on the general knowledge of person skilled in the art, obviously indicates minor adjustments or adjustments in a small extent. According to the experiences and practices of the inventor of this application, if a rated operating frequency is 50 HZ, it will be feasible if the adjustment of the frequency of the output voltage of the frequency converter is set within 40 HZ-60 HZ. Certainly, if it is adjusted to another frequency range, it can still be feasible as long as the power requirements of the electronic ballast/LED driving unit can be satisfied.

III. Third Solution

This third solution is the same with second solution in hardware combination, but slightly different from second solution in specific dimming method. The specific dimming rules and method of this third solution comprise the following.

(1) creating corresponding relation between the parameter of the frequency fluctuation of the output voltage of the frequency converter and the target dimming extent, wherein the parameter of the frequency fluctuation comprises the amplitude value of every frequency fluctuation, and/or the duration of every frequency fluctuation, and/or every interval time between the frequency fluctuations; and (2) when dimming is required, controlling the frequency of the output voltage of the frequency converter to generate corresponding fluctuation according to the predetermined corresponding relation of the step (1) and the target dimming extent; and configuring the dimming control unit to detect the frequency variation of the power supply voltage of the input terminal of the electronic ballast/LED driving unit, to obtain the target dimming extent by checking with the predetermined corresponding relation, and to adjust the output frequency of the electronic ballast and the output current of the LED driving unit to the corresponding values, so as to implement dimming of the fluorescent lamp/LED light.

It can be noted by contrasting and analyzing the dimming methods of the above second and third solutions to it of the above first solution that the above second and third solutions have all the advantages that the above first solution has. Besides, because the above first solution is to generate specific short-time fluctuations on the voltage value of the power supply of the input terminal of the electronic ballast/LED driving unit and to utilize them as extremely low frequency control commands to conduct dimming through relating these commands with the dimming extents, while the above second and third solutions are to make changes or fluctuations on the frequency of the power supply voltage of the input terminal of the electronic ballast/LED driving unit and to conduct dimming through relating these frequency variations or fluctuations to the dimming extents, the above second and third solutions can obviously achieve more accurate and fast dimming response and be more suitable for the contexts of frequent dimming and cyclic dimming (such as floodlighting, landscape lighting, and etc.).

In addition, according to the general knowledge of person skilled in the art, the dimming control unit according to the present invention can adapt to integration design very easily. The dimming control unit and the electronic ballast/LED driving unit can easily be integrated, made into a chip, or modularized as well. Therefore, the installation and implementation of the system can become easier, the system construction costs can be reduced, and the operation reliability of the system can be increased.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

The following will combine the drawings and embodiments to further describe the stepless dimming control method of lighting system according to the present invention.

1. Voltage Adjustment Type

Figure 1:
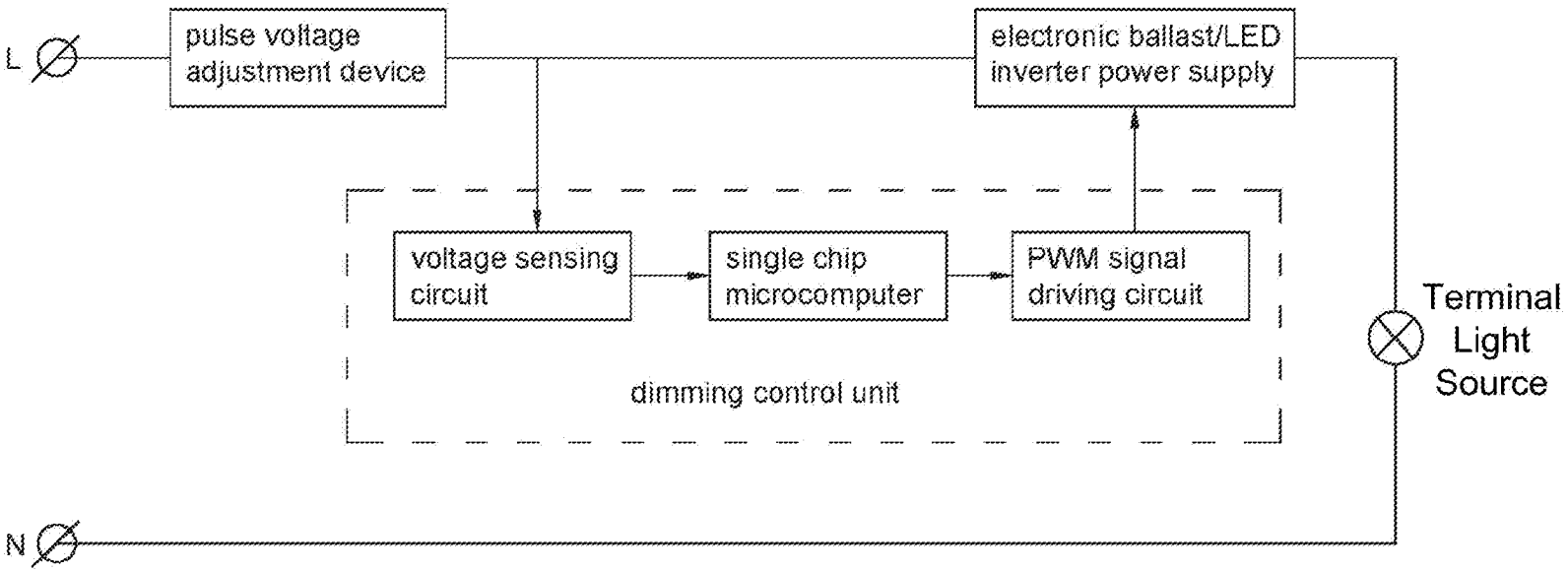
FIG. 1 is a schematic diagram illustrating a circuit (voltage adjustment type) of a lighting system and a stepless dimming control method thereof according to a first preferred embodiment of the present invention.
Figure 2:
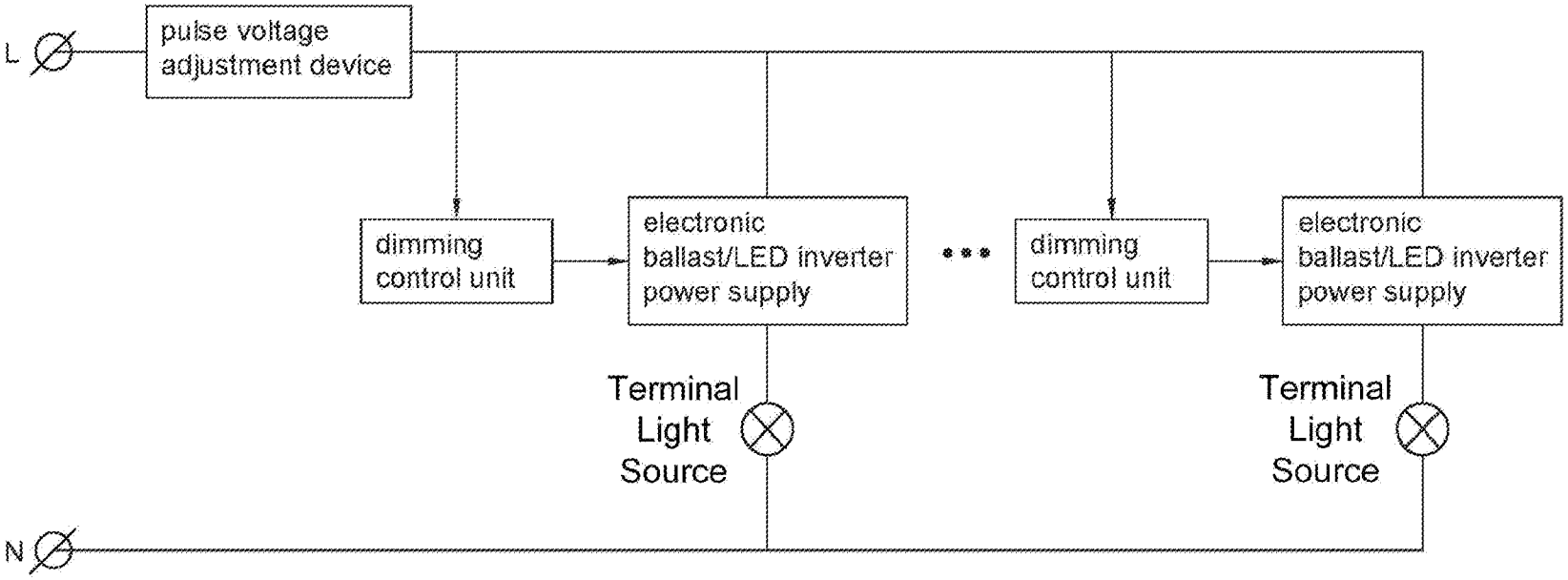
FIG. 2 is a schematic diagram illustrating a circuit (voltage adjustment type) of a lighting system and a stepless dimming control method thereof according to a second preferred embodiment of the present invention.
Figure 3:
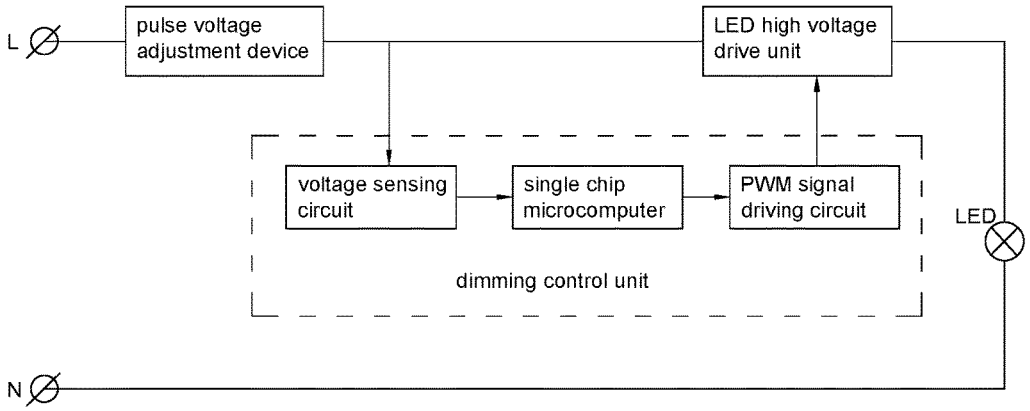
FIG. 3 is a schematic diagram illustrating a circuit (voltage adjustment type) of a lighting system and a stepless dimming control method thereof according to a third preferred embodiment of the present invention.

I. Employing Pulse Voltage Adjustment Device to Adjust the Voltage:

FIGS. 1, 2, and 3 are respectively schematic diagrams illustrating circuits of the lighting systems and their stepless dimming control methods according to the first to third embodiments of the present invention. Referring to FIGS. 1-3, the first to third embodiments of the lighting system corresponded to the stepless dimming control method of lighting system according to the present invention each requires connecting pulse voltage adjustment device to the main power supply circuit of the terminal light source. The terminal light source can employ fluorescent lamp, LED light, or both. The fluorescent lamp and LED light have corresponding electronic ballast or LED driving unit arranged according to regular standard. The system also requires a dimming control unit of a voltage sensing circuit and a single chip microcomputer arranged thereon. The voltage sensing circuit is adapted for monitoring the power supply voltage of the input terminal of the electronic ballast/LED driving unit for the single chip microcomputer to transmit corresponding dimming control signal based on the changes of the power supply voltage and the preset rules of the system to the voltage adjustment terminal of the electronic ballast/LED driving unit, such that the electronic ballast/LED driving unit can adjust the output frequency of the electronic ballast and the output current of the LED driving unit according to the dimming control signal, so as to implement dimming.

The pulse voltage adjustment device of the first to third embodiments of the present invention may employ mature conventional technology, comprising employing substitutions of autotransformer, compensated voltage regulator, and etc. Here is a specific option for compensated voltage regulator:

connecting the secondary winding of the compensator transformer in series to the main power supply circuit of the terminal light source, and connecting the end tap of the primary winding of the compensator transformer or the end tap and the middle tap of the primary winding of the compensator transformer to the power source via controlling switch.

When dimming is required, different output voltages are generated in the two ends of the secondary winding of the compensator transformer through the variable ratio relation between the secondary winding and the primary side operating winding rendered by switching between different winding coils of the primary winding of the compensator transformer or the switching of the corresponding controlling switch. In the situation that automatic dimming is demanded, it can then selectively employ the smart control module for the controlling switch.

The LED driving unit mentioned in the embodiments of the present invention can be configured and setup based on the standards of conventional LED light, comprising employing LED inverter power supply (referring to FIGS. 1 and 2), LED high voltage driving circuit (referring to FIG. 3), and etc.

Referring to FIG. 1, it also provides an embodiment of the dimming control unit. One of the I/O ports and/or A/D signal receiving ports of the single chip microcomputer is connected with the signal output terminal of the voltage sensing circuit. The single chip microcomputer also comprises a PWM signal output terminal arranged thereon. The PWM signal output terminal is connected with the dimming console of the electronic ballast/LED driving unit via the PWM signal driving circuit. Certainly, if the PWM signal output terminal of a single chip microcomputer is enough to drive the dimming console of the electronic ballast/LED driving unit, the PWM signal driving circuit can also be omitted as illustrated in FIG. 3.

When dimming is required, it can selectively employ one of the following methods to be cooperated with the actual environment and demand of the operation system:

1. First Method, Comprising the Following Utility Method and Procedures:

(i) causing the value of the power supply voltage of the input terminal of the electronic ballast/LED driving unit to generate a short-time fluctuation by slightly adjusting the output voltage of the pulse voltage adjustment device for the first time, wherein in order to describe easily hereinafter, the short-time fluctuation is defined as first signaling and, besides, the fluctuation duration of the first signaling is T1;

(ii) causing the value of the power supply voltage of the input terminal of the electronic ballast/LED driving unit to generate a short-time fluctuation by slightly adjusting the output voltage of the pulse voltage adjustment device again after a time interval of T2, wherein this short-time fluctuation is defined as second signaling, and the fluctuation duration of the second signaling is T3, wherein the fluctuation duration T3 has a predetermined corresponding relation with the target dimming extent;

(iii) comparing the durations of T1, T2, and T3 with the predetermined value of the system after the dimming control unit detected the above fluctuations of the value of the power supply voltage of the input terminal of the electronic ballast/LED driving unit, wherein if the values are equal, the dimming procedure of this time is really launched that the output frequency of the electronic ballast and the output current of the LED driving unit is adjusted to corresponding values according to the target dimming extent obtained by configuring the dimming control unit to check the predetermined value of the system according to the fluctuation duration of T3, wherein if the values are not equal, the dimming procedure of this time is terminated.

For example, the first signaling is configured to utilize the pulse voltage adjustment device to increase (or decrease) the power supply voltage value of the input terminal of the electronic ballast/LED driving unit for 5V for is (that is the duration T1), to restore it next, to increase (or decrease) the power supply voltage value of the input terminal of the electronic ballast/LED driving unit for 8V for 30 s (that is the duration T3) after an interval time of 0.2 s (that is the duration T2), and then to restore it again. Thereafter, the durations of T1, T2, and T3 are compared with the predetermined value of the system after the dimming control unit detected the above fluctuations of the value of the power supply voltage of the input terminal of the electronic ballast/LED driving unit, wherein if the values are equal, the dimming procedure of this time is really launched that the output frequency of the electronic ballast and the output current of the LED driving unit will be adjusted to corresponding values when the corresponding target dimming extent of T3=30 s is obtained by configuring the dimming control unit to check the predetermined value of the system, wherein if the values are not equal, the dimming procedure of this time is terminated.

2. Second Method, Comprising the Following Utility Method and Procedures:

This second method is mostly the same with the above first method, wherein the differences comprise the following: In this second method, the interval time, T2, between the first signaling and the second signaling is predetermined to have predetermined corresponding relation to the target dimming extent, wherein the wave pattern of the second signaling and/or fluctuation duration T3 and the wave patterns of the first signaling are all be regarded as the basis of determination for really launching this dimming procedure.

That is the durations of T1, T2, and T3 with the predetermined value of the system are compared after the dimming control unit detected the above fluctuations of the value of the power supply voltage of the input terminal of the electronic ballast/LED driving unit, wherein if the values are equal, the dimming procedure of this time is really launched that the output frequency of the electronic ballast and the output current of the LED driving unit will be adjusted to corresponding values according to the target dimming extent obtained by configuring the dimming control unit to check the predetermined value of the system according to the interval time of T2, wherein if the values are not equal, the dimming procedure of this time is terminated, For example, the interval time 0.2 s between two fluctuations (which is the duration T2) has a predetermined corresponding relation to the target dimming extent in the system for those examples of the above first method as long as they apply this second method to conduct dimming. When the conditions for really launching the dimming procedure of the time are met, the dimming control unit adjust the output frequency of the electronic ballast and the output current of the LED driving unit to the corresponding values after it checked the predetermined values of the system and learned the corresponding target dimming extent of the interval time of 0.2.

3. Third Method, Comprising the Following Utility Method and Procedures:

This third method is an improvement of the above first and second methods. The differences comprise enhancement of the interference resistance or antijamming performance of dimming. That is this third method employs more complex fluctuation parameters as the basis of determination for the real launching of the dimming procedure. That is to say, the first signaling and/or the second signaling have one or more times of minor fluctuation on voltage value, wherein after the dimming control unit detected the fluctuation of the voltage value of the power supply of the input terminal of the electronic ballast/LED driving unit, the parameters of the specific wave pattern of the first signaling and/or the second signaling will also be compared with the predetermined value of the system, wherein the compared parameters of wave pattern comprise the amplitude value of every voltage fluctuation, and/or the duration of every voltage fluctuation, and/or every interval time between the voltage fluctuations.

For example, if the third method is utilized on the examples of the above first method for conducting dimming, the amplitude value 5V of the fluctuation of the first signaling and the amplitude value 8V of the fluctuation of the second signaling will both be basis of determination for determining if the dimming procedure can really be launched. Apparently, this third method is helpful in preventing risk factors like voltage fluctuation of the power network from possibly rendering interference thereto.

4. Fourth Method, Comprising the Following Utility Method and Procedures:

This fourth method is an improvement on the basis of the above first to third methods. Specifically, it further comprises a step of confirming the received voltage fluctuation before the dimming control unit really launches the dimming procedure to the electronic ballast and the LED driving unit, wherein the dimming procedure is really launched only if first signaling is received again or a specific voltage fluctuation is received in the designated duration of T4. The specific voltage fluctuation can be determined by person skilled in the art. For example, it can be a specific amplitude value and/or one or more small scale fluctuations of the voltage for specific duration.

5. Fifth Method, Comprising the Following Utility Method and Procedures:

This fifth method is an improvement on the bases of the above first to fourth methods. Specifically, it further comprises a step of detecting if the electric current of the lighting circuit change correspondingly after the dimming procedure is really launched. If the current is not changed correspondingly, this dimming is considered failed and the dimming procedure will be launched again.

II. Employing Frequency Converter to Adjust the Voltage

The embodiments of the present invention that employ frequency converter to adjust voltage apply program is completely identical to the above implementations that adjust voltage with pulse voltage adjustment device in all aspects, comprising hardware combination, dimming principles, dimming methods, and dimming procedures, except for utilizing frequency converter to directly substitute the pulse voltage adjustment device for voltage adjusting.

Figure 4:
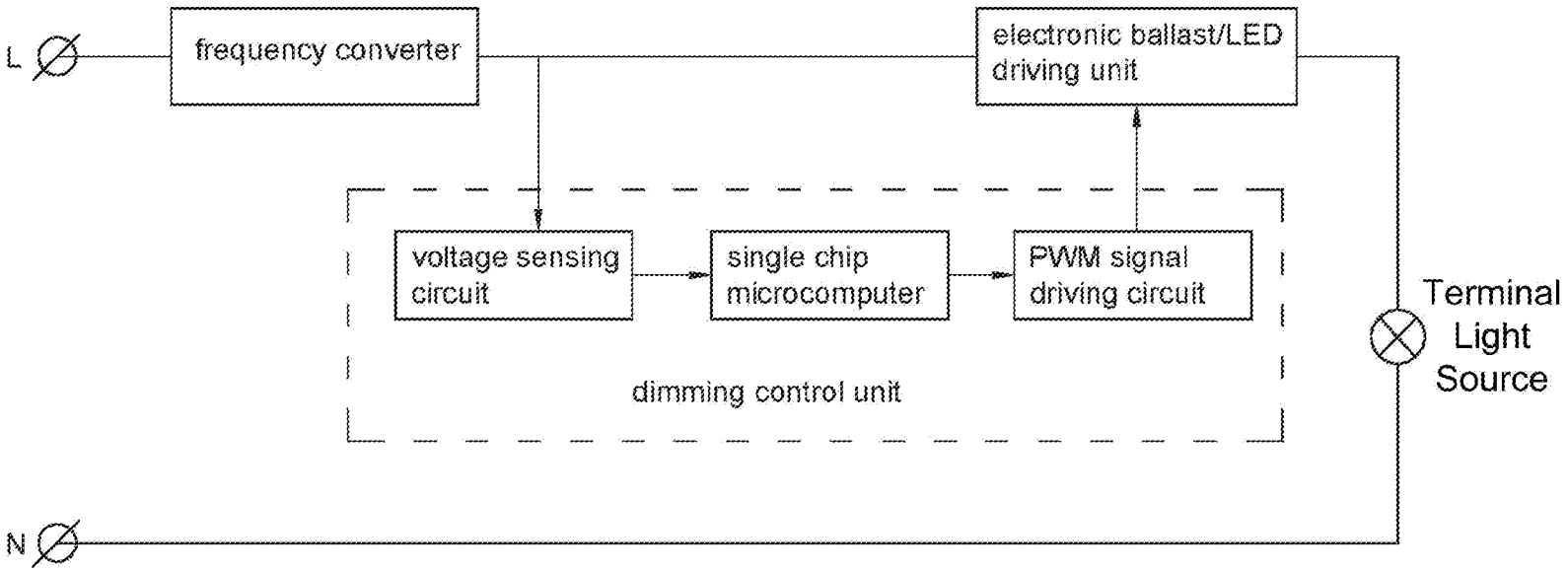
FIG. 4 is a schematic diagram illustrating a circuit (frequency converter voltage adjustment type) of a lighting system and a stepless dimming control method thereof according to a fourth preferred embodiment of the present invention.

Schematic diagram of the exemplar circuit composition is illustrated in FIG. 4.

2. Frequency Adjustment Type

Figure 5:
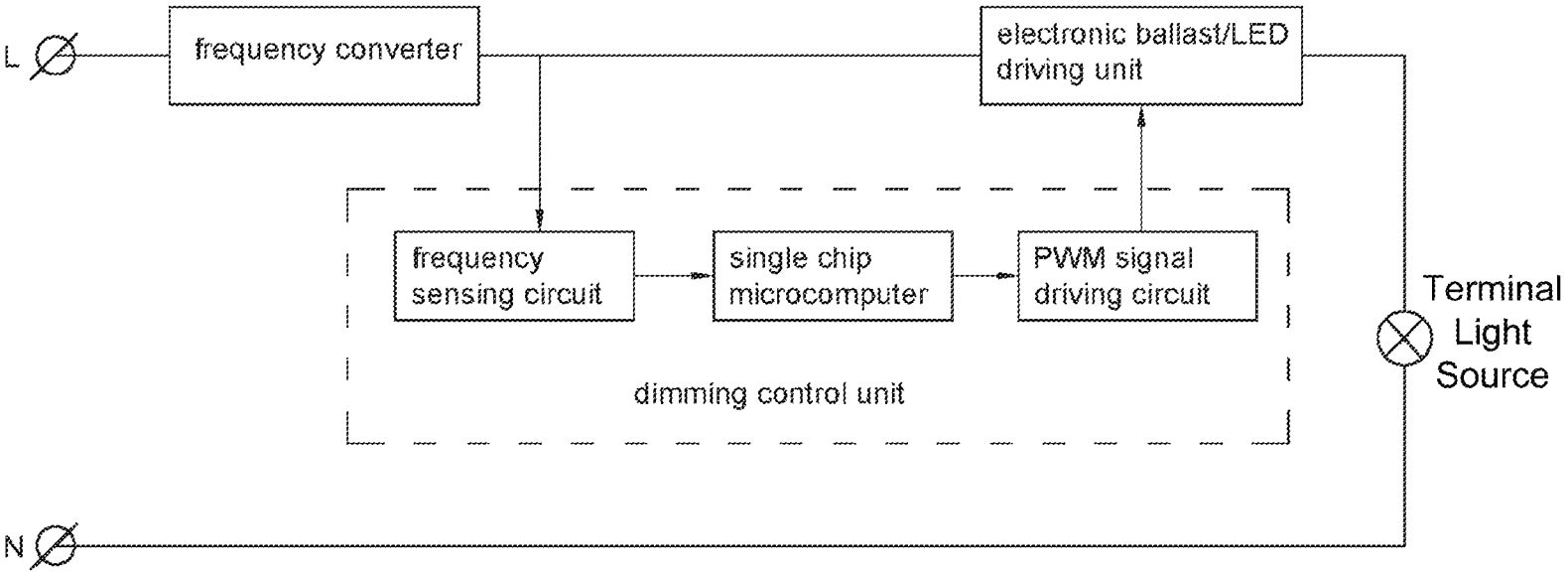
FIG. 5 is a schematic diagram illustrating a circuit (frequency converter frequency adjustment type) of a lighting system and a stepless dimming control method thereof according to a first preferred embodiment of the present invention.

Referring to FIG. 5, a circuit assembly of the lighting system corresponding to the frequency adjustment type stepless dimming control method of a lighting system according to the present invention is embodied. Comparing FIG. 5 to FIGS. 1 and 4, the hardware combination of this frequency adjustment type solution is mostly the same with it of the above voltage adjustment type solution, wherein the differences comprise the following:

First, this frequency adjustment type solution in terms of its hardware combination only comprises the situation of utilizing frequency converter, but the situation of utilizing the pulse voltage adjustment device.

Besides, the voltage sensing circuit of the dimming control unit is replaced with a frequency sensing circuit. The function of the dimming control unit is somewhat different in the present frequency adjustment type embodiment to the voltage adjustment type embodiment. The dimming control unit is altered for monitoring the frequency variation of the power supply voltage of the input terminal of the electronic ballast/LED driving unit, and then adjusting the output frequency of the electronic ballast and the output current of the LED driving unit according to the predetermined rules of the system, so as to implement dimming of the fluorescent lamp/LED light.

The frequency adjustment type dimming method according to the present invention can be embodied as the following two methods (when dimming is required, it can selectively employ one of the following methods to be cooperated with the actual environment and demand of the operation system):

1. First Method, Comprising the Following Utility Contents and Rules:

(1) providing corresponding relation between the frequency of the output voltage of the frequency converter and the target dimming extent, or providing corresponding relation between the difference between the frequency of the output voltage of the frequency converter and the rated operating frequency and the target dimming extent; and (2) when dimming is required, adjusting the frequency of the output voltage of the frequency converter to the corresponding value according to the predetermined corresponding relation of said step (1) and the target dimming extent; and then configuring the dimming control unit to detect the frequency variation of the power supply voltage of the input terminal of the electronic ballast/LED driving unit, to obtain the target dimming extent by checking with the predetermined corresponding relation, and to adjust the output frequency of the electronic ballast and the output current of the LED driving unit to the corresponding values, so as to implement the dimming function.

For example, if the rated operating frequency is 50 HZ, it can configure the target dimming extent for every ±1 HZ change of the frequency of the output voltage of the frequency converter to be ±10%. Therefore, when the frequency sensing circuit detected that the frequency of the power supply voltage of the input terminal of the electronic ballast/LED driving unit is 55 HZ, the processor can obtain that the target dimming extent is 50% increase after checking with the predetermined value of the system, and then transmit corresponding dimming control signal to adjust the output frequency of the electronic ballast and the output current of the LED driving unit, so as to implement accurate dimming.

2. Second Method, Comprising the Following Utility Contents and Rules:

(1) creating corresponding relation between the parameter of the frequency fluctuation of the output voltage of the frequency converter and the target dimming extent, wherein the parameter of the frequency fluctuation comprises the amplitude value of every frequency fluctuation, and/or the duration of every frequency fluctuation, and/or every interval time between the frequency fluctuations;

(2) when dimming is required, controlling the frequency of the output voltage of the frequency converter to generate corresponding fluctuation according to the predetermined corresponding relation of said step (1) and the target dimming extent; and configuring the dimming control unit to detect the frequency variation of the power supply voltage of the input terminal of the electronic ballast/LED driving unit to obtain the target dimming extent by checking with the predetermined corresponding relation, and to adjust the output frequency of the electronic ballast and the output current of the LED driving unit to the corresponding values, so as to implement accurate dimming.

For example, generating one or more times of short-time fluctuations of the frequency of the power supply voltage of the input terminal of the electronic ballast/LED driving unit through slightly adjusting the frequency of the output voltage of the frequency converter. Then, after the dimming control unit detected amplitude value of every frequency fluctuation, every duration, and every interval time, and checked with the predetermined values of the system, it can confirm if the frequency fluctuation is a valid dimming command. If so, it can simultaneously learn the target dimming extent and transmit corresponding dimming control signal to adjust the output frequency of the electronic ballast and the output current of the LED driving unit to corresponding values, so as to implement accurate dimming.

The above disclosure simply provides some preferred embodiments of the present invention, which shall not be considered as limited implementations of the present invention. The equivalents, alternatives, and improvements according to the technical solutions of the present invention that person skilled in the art can possibly make shall all be within the scope and coverage of the technical solution of the present invention.

INDUSTRIAL UTILITY

It can be easily noted by person skilled in the art according to the above disclosure that the technical solutions according to the present invention are suitable for being produced in the industry and utilized in the household. Hence, the present invention has industrial utility.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A stepless dimming control method for a lighting system, comprising the steps of:

causing a value of a power supply voltage of an input terminal of a LED driving unit of a terminal light source of the lighting system to generate a first short-time fluctuation by slightly adjusting an output voltage of a smart pulse voltage adjustment device which is connected on a power supply circuit of a terminal light source in series for a first time when dimming is demanded, wherein the first short-time fluctuation is defined as a first signaling, wherein a fluctuation duration of the first signaling is T1;

causing the value of the power supply voltage of the input terminal of the LED driving unit to generate a second short-time fluctuation by slightly adjusting the output voltage of the smart pulse voltage adjustment device again after a time interval duration of T2, wherein the second short-time fluctuation is defined as a second signaling, wherein a fluctuation duration of the second signaling is T3, wherein the fluctuation duration T3 has a predetermined corresponding relation with a target dimming extent; and comparing the durations of T1, T2, and T3 with a predetermined value of the system after a dimming control unit arranged on the LED driving unit of the lighting system detected the above fluctuations of the value of the power supply voltage of the input terminal of the LED driving unit, wherein if the values are equal, a dimming step of this time is really launched that an output current of the LED driving unit is adjusted to corresponding values according to the target dimming extent obtained by configuring the dimming control unit to check a predetermined value of the lighting system according to the fluctuation duration of T3, wherein if the values are not equal, the dimming step of this time is terminated, wherein the LED driving unit comprises one of an LED inverter power supply and an LED high voltage drive unit, wherein the smart pulse voltage adjustment device is allowed to be replaced by a frequency converter, while the method unchanged after such replacement.

2. The method, as recited in claim 1, wherein the time interval duration, T2, between the first signaling and the second signaling is predetermined to have a predetermined corresponding relation to the target dimming extent, wherein information including a wave pattern of the second signaling, or the wave pattern of the second signaling plus the fluctuation duration T3, and a wave patterns of the first signaling is regarded as a basis of determination for really launching the dimming step, wherein the durations of T1, T2, and T3 are compared with the predetermined value of the system after the dimming control unit detected the above fluctuations of the value of the power supply voltage of the input terminal of the LED driving unit, wherein if the values are equal, the dimming step of this time is really launched that the output current of the LED driving unit is adjusted to corresponding values according to the target dimming extent obtained by configuring the dimming control unit to check the predetermined value of the system according to the time interval duration of T2, wherein if the values are not equal, the dimming step of this time is terminated.

3. The method, as recited in claim 2, wherein the first signaling and the second signaling have one or more times of minor fluctuations on a voltage value respectively, wherein after the dimming control unit detected the fluctuation of the voltage value of the power supply of the input terminal of the LED driving unit, parameters of the specific wave pattern of both or one of the first signaling and the second signaling is also be compared with the predetermined value of the system to provide a basis of determination for really launching this dimming step, wherein compared parameters of the wave pattern comprise one or more parameters selected from the group consisting of an amplitude value of every of the voltage fluctuations, a duration of every of the voltage fluctuations, and every of the interval durations between the voltage fluctuations.

4. The method, as recited in claim 3, further comprising a step of confirming the voltage fluctuation received before the dimming control unit really launches the dimming step to the LED driving unit, wherein the dimming step is really launched only if the first signaling is received again or a specific voltage fluctuation is received in a designated duration of T4.

5. The method, as recited in claim 4, further comprising a step of detecting if an electric current of a lighting circuit changes correspondingly after the dimming step is really launched, wherein if the current is not changed correspondingly, this dimming step is considered failed and the dimming step is going to be launched again.

6. The method, as recited in claim 4, wherein the fluctuation extend of the slightly adjusted output voltage of the smart pulse voltage adjustment device is within a range of ±50V and the durations T1, T2, and T3 are 0.2 to 300 seconds.

7. The method, as recited in claim 4, wherein the dimming control unit comprises a single chip microcomputer, the voltage sensing circuit monitoring the power supply voltage of the input terminal of the LED driving unit, and a PWM signal driving circuit, wherein one of I/O ports or A/D signal receiving ports of the single chip microcomputer is connected with a signal output terminal of the voltage sensing circuit, wherein the single chip microcomputer also comprises a PWM signal output terminal, wherein the PWM signal output terminal is connected with the dimming console of the LED driving unit via the PWM signal driving circuit.

8. The method, as recited in claim 2, wherein when the pulse voltage adjustment device is replaced by a frequency converter, the voltage sensing circuit of the dimming control unit is replaced by a frequency sensing circuit, such that the dimming control unit becomes monitoring a frequency variation of the power supply voltage of the input terminal of the LED driving unit and adjusting the output current of the LED driving unit according to predetermined rules of the system, wherein the dimming method comprising employing the following contents and rules:

(1) providing a corresponding relation between a frequency of an output voltage of the frequency converter and the target dimming extent, or providing a corresponding relation between the target dimming extent and a difference between a frequency of the output voltage of the frequency converter and a rated operating frequency; and (2) when dimming is required, adjusting the frequency of the output voltage of the frequency converter to a corresponding value according to a predetermined corresponding relation of said step (1) and the target dimming extent; and configuring the dimming control unit to detect a frequency variation of the power supply voltage of the input terminal of the LED driving unit, to obtain a target dimming extent by checking with the predetermined corresponding relation, and to adjust an output current of the LED driving unit to corresponding values.

9. The method, as recited in claim 8, wherein the dimming control unit and the LED driving unit are integrated into a chip or module.

10. The method, as recited in claim 1, wherein the first signaling and the second signaling have one or more times of minor fluctuations on a voltage value respectively, wherein after the dimming control unit detected the fluctuation of the voltage value of the power supply of the input terminal of the LED driving unit, parameters of the specific wave pattern of both or one of the first signaling and the second signaling is also be compared with the predetermined value of the system to provide a basis of determination for really launching this dimming step, wherein compared parameters of the wave pattern comprise one or more parameters selected from the group consisting of an amplitude value of every of the voltage fluctuations, a duration of every of the voltage fluctuations, and every of the interval durations between the voltage fluctuations.

11. The method, as recited in claim 10, further comprising a step of confirming the voltage fluctuation received before the dimming control unit really launches the dimming step to the LED driving unit, wherein the dimming step is really launched only if the first signaling is received again or a specific voltage fluctuation is received in a designated duration of T4.

12. The method, as recited in claim 11, further comprising a step of detecting if an electric current of a lighting circuit changes correspondingly after the dimming step is really launched, wherein if the current is not changed correspondingly, this dimming step is considered failed and the dimming step is going to be launched again.

13. The method, as recited in claim 12, wherein the fluctuation extent of the slightly adjusted output voltage of the smart pulse voltage adjustment device is within a range of ±50V and the durations T1, T2, and T3 are 0.2 to 300 seconds.

14. The method, as recited in claim 12, wherein the dimming control unit comprises a single chip microcomputer, the voltage sensing circuit monitoring the power supply voltage of the input terminal of the LED driving unit, and a PWM signal driving circuit, wherein one of I/O ports or A/D signal receiving ports of the single chip microcomputer is connected with a signal output terminal of the voltage sensing circuit, wherein the single chip microcomputer also comprises a PWM signal output terminal, wherein the PWM signal output terminal is connected with the dimming console of the LED driving unit via the PWM signal driving circuit.

15. The method, as recited in claim 1, wherein when the pulse voltage adjustment device is replaced by a frequency converter, the voltage sensing circuit of the dimming control unit is replaced by a frequency sensing circuit, such that the dimming control unit becomes monitoring a frequency variation of the power supply voltage of the input terminal of the LED driving unit and adjusting the output current of the LED driving unit according to predetermined rules of the system, wherein the dimming method employing the following contents and rules:

(1) providing a corresponding relation between a frequency of an output voltage of the frequency converter and the target dimming extent, or providing a corresponding relation between the target dimming extent and a difference between a frequency of the output voltage of the frequency converter and a rated operating frequency; and (2) when dimming is required, adjusting the frequency of the output voltage of the frequency converter to a corresponding value according to a predetermined corresponding relation of said step (1) and the target dimming extent; and configuring the dimming control unit to detect a frequency variation of the power supply voltage of the input terminal of the LED driving unit, to obtain a target dimming extent by checking with the predetermined corresponding relation, and to adjust an output current of the LED driving unit to corresponding values.

16. The method, as recited in claim 15, wherein the dimming control unit and the LED driving unit are integrated into a chip or module.

17. The method, as recited in claim 1, wherein when the pulse voltage adjustment device is replaced by a frequency converter, the voltage sensing circuit of the dimming control unit is replaced by a frequency sensing circuit, such that the dimming control unit becomes monitoring a frequency variation of the power supply voltage of the input terminal of the LED driving unit and adjusting the output current of the LED driving unit according to predetermined rules of the system, wherein the dimming method employing the following contents and rules:

(1) providing a corresponding relation between a parameter of a frequency fluctuation of the output voltage of the frequency converter and a target dimming extent, wherein the parameter of the frequency fluctuation comprises one or more parameters selected from the group consisting of a amplitude value of every of the frequency fluctuations, a duration of every of the frequency fluctuations, and every of the interval times between the frequency fluctuations; and (2) when dimming is required, controlling the frequency of the output voltage of the frequency converter to generate a corresponding fluctuation according to the predetermined corresponding relation of the step (1) and the target dimming extent; and configuring the dimming control unit to detect a frequency variation of the power supply voltage of the input terminal of the LED driving unit, to obtain a target dimming extent by checking with the predetermined corresponding relation, and to adjust an output current of the LED driving unit to the corresponding values.

18. The method, as recited in claim 17, wherein the dimming control unit and the LED driving unit are integrated into a chip or module.

19. The method, as recited in claim 2, wherein when the pulse voltage adjustment device is replaced by a frequency converter, the voltage sensing circuit of the dimming control unit is replaced by a frequency sensing circuit, such that the dimming control unit becomes monitoring a frequency variation of the power supply voltage of the input terminal of the LED driving unit and adjusting the output current of the LED driving unit according to predetermined rules of the system, wherein the dimming method employing the following contents and rules:

(1) providing a corresponding relation between a parameter of a frequency fluctuation of the output voltage of the frequency converter and a target dimming extent, wherein the parameter of the frequency fluctuation comprises one or more parameters selected from the group consisting of a amplitude value of every of the frequency fluctuations, a duration of every of the frequency fluctuations, and every of the interval times between the frequency fluctuations; and (2) when dimming is required, controlling the frequency of the output voltage of the frequency converter to generate a corresponding fluctuation according to the predetermined corresponding relation of the step (1) and the target dimming extent; and configuring the dimming control unit to detect a frequency variation of the power supply voltage of the input terminal of the LED driving unit, to obtain a target dimming extent by checking with the predetermined corresponding relation, and to adjust an output current of the LED driving unit to the corresponding values.

20. The method, as recited in claim 19, wherein the dimming control unit and the LED driving unit are integrated into a chip or module.

* * * * *